US010099112B1

(12) United States Patent
Johnson

(10) Patent No.: US 10,099,112 B1
(45) Date of Patent: Oct. 16, 2018

(54) THREE-DIMENSIONAL TIC-TAC-TOE

(71) Applicant: Randall Johnson, Boynton Beach, FL (US)

(72) Inventor: Randall Johnson, Boynton Beach, FL (US)

( * ) Notice: Subject to any disclaimer, the term of this patent is extended or adjusted under 35 U.S.C. 154(b) by 124 days.

(21) Appl. No.: 15/375,148

(22) Filed: Dec. 11, 2016

Related U.S. Application Data

(60) Provisional application No. 62/268,103, filed on Dec. 16, 2015.

(51) Int. Cl.
*A63F 3/00* (2006.01)

(52) U.S. Cl.
CPC ..... *A63F 3/00214* (2013.01); *A63F 3/00094* (2013.01); *A63F 3/00261* (2013.01); *A63F 3/00643* (2013.01); *A63F 3/00697* (2013.01); *A63F 2003/0022* (2013.01); *A63F 2003/00274* (2013.01); *A63F 2003/00652* (2013.01); *A63F 2003/00662* (2013.01); *A63F 2003/00716* (2013.01)

(58) Field of Classification Search
CPC ..... A63H 33/22; A63H 33/26; A63H 33/042; A63F 3/00094; A63F 3/00214; A63F 3/00643; A63F 2003/00646
See application file for complete search history.

(56) References Cited

U.S. PATENT DOCUMENTS 2,801,107 A 7/1957 Greer, Jr.
3,145,993 A * 8/1964 Archer ..... A63F 3/00643 273/139
3,237,341 A * 3/1966 Janning ..... F21S 9/02 273/238
3,464,701 A 9/1969 Mahoney
3,849,912 A * 11/1974 Kemnitzer ..... G09B 19/00 434/98
3,879,040 A 4/1975 Smith
3,884,474 A 5/1975 Harper
3,888,487 A 6/1975 Replogle
(Continued)

*Primary Examiner* — Gene Kim
*Assistant Examiner* — Alyssa Hylinski
(74) *Attorney, Agent, or Firm* — H. John Rizvi; Gold & Rizvi, P.A.

(57) ABSTRACT

An illuminated, three-dimensional tic-tac-toe game device is provided and includes a game board having nine posts arranged in a square. Each post includes three levels of play and a first switch and a second switch at each level. First and second game pieces are provided for use as X's and O's in the game. Each game piece includes translucent sides, a translucent top and an opaque bottom. First contacts are provided on each first game piece and are engageable with the first switches and second contacts are provided on each second game piece and are engageable with the second switches. An electronic circuit is provided for each possible combination of three of the same game pieces in a row either horizontally, vertically, transversely or diagonally. Lights are provided at each level within each post, either within each level of each post or inside a game piece arranged at the level. The electronic circuit activates the lights to illuminate through the translucent game pieces when one player establishes three of his game pieces in a row.

20 Claims, 6 Drawing Sheets

(56) References Cited

U.S. PATENT DOCUMENTS

| | | | | | |
|---|---|---|---|---|---|
| 4,485,585 | A * | 12/1984 | Shackelford | A63F 9/06 | 434/258 |
| 5,116,061 | A * | 5/1992 | Zentner, Jr. | A63F 3/00094 | 273/241 |
| 5,269,529 | A * | 12/1993 | Clemente | A63F 3/00643 | 273/238 |
| 5,433,448 | A | 7/1995 | Raphael et al. | | |
| 5,560,605 | A * | 10/1996 | Garcia | A63F 9/0073 | 273/153 P |
| 5,876,262 | A * | 3/1999 | Kelly | A63H 33/22 | 108/23 |
| 6,679,751 | B1 * | 1/2004 | Maxwell | A63H 33/00 | 446/124 |
| 6,755,713 | B1 * | 6/2004 | Weber | A63H 5/00 | 446/143 |
| D513,043 | S | 12/2005 | Hunley | | |
| D594,511 | S * | 6/2009 | Smyth | D21/337 | |
| 7,566,057 | B2 * | 7/2009 | Mascolo | A63F 9/0073 | 273/153 J |
| 7,857,624 | B2 * | 12/2010 | Davis | G09B 7/00 | 273/156 |
| 7,946,587 | B1 * | 5/2011 | Renfro | A63F 3/00094 | 273/241 |
| 8,505,918 | B1 * | 8/2013 | Appelblatt | A63F 3/00 | 273/239 |
| 9,884,235 | B2 * | 2/2018 | Min | A63G 31/02 | |
| 2010/0003651 | A1 * | 1/2010 | Zilber | A63F 9/10 | 434/208 |
| 2014/0239588 | A1 * | 8/2014 | Fry | A63F 3/00094 | 273/153 S |

* cited by examiner

THREE-DIMENSIONAL TIC-TAC-TOE

CROSS-REFERENCE TO RELATED APPLICATIONS

This application claims the benefit of U.S. Provisional Patent Application Ser. No. 62/268,103, filed on Dec. 16, 2015, which is incorporated by reference herein in its entirety.

FIELD OF THE INVENTION

The present invention relates generally to three-dimensional tic-tac-toe games and, more particularly, to a three-dimensional tic-tac-toe game device that incorporates an electrical circuit to provide visual and audio indicators for indicating a win in the game.

BACKGROUND OF THE INVENTION

Tic-Tac-Toe is a basic board or handwritten game for two players. It is a simple, completing-the-squares type game played out on a flat, single plane, rectangular diagram of nine places or squares with three squares to each side. The nine squares are usually laid out with cross hatched lines on a flat sheet of paper or board. The object of the game is for a player to claim three of the squares in a row either horizontally, transversely or diagonally on the board in order to win the game. The players take alternate turns claiming the squares by marking or placing pieces on squares of the diagram until one player claims three squares in a row or the game ends in a tie.

Once the basics of this simple game have been mastered by both players, a typical game of tic-tac-toe usually ends in a tie or draw with neither player winning. In order to make the game more challenging, various attempts have been made to utilize a three-dimensional (3D) large cube or rectangular block as the playing framework. The block is organized like a two-dimensional game but has three tiers or levels. Thus, the block includes twenty-seven places or cube spaces as opposed to the nine flat squares in a typical two-dimensional game. These three-dimensional games may be provided on a computer-generated image or in a physical three-dimensional framework or lattice. In this type of three-dimensional game of tic-tac-toe, the players still take turns claiming "squares or places", in the form of the cube spaces within the twenty-seven place block, but can claim them anywhere within the three tiers of the block to still get three squares in a row in any direction to win. In this three-dimensional tic-tac-toe game, the three pieces can be aligned in horizontal, transverse or diagonal direction, like in the two dimensional game, but also in a vertical direction or any combination thereof to win.

Because the playing framework is rather complicated, the ability to see or ascertain exactly where each playing piece or mark lies within the block may be obstructed by other playing pieces or marks or the framework structure itself. Thus, since some cube spaces may be hidden inside, it may be difficult to see if a player has established or claimed three cubes in a row to win. Further, it is sometimes difficult during the fast play of the game to determine if any one player has already established three pieces or cube spaces in a row before the other player takes his turn.

Accordingly, there is an established need for a three-dimensional tic-tac-toe game structure that provides an immediate and positive indication when a player has established three spaces in a row to win the game. There is also, more particularly, a need for a three-dimensional tic-tac-toe game that can give a visual and/or auditory indication of a win.

SUMMARY OF THE INVENTION

The present invention is directed to an illuminated, multi-dimensional game device for playing tic-tac-toe.

In a first implementation of the invention, an illuminated, three-dimensional tic-tac-toe game device comprises a game board having a plurality of game posts extending vertically upward from the game board. Each game post has at least three levels arranged in a vertically stacked relationship, each level comprising a respective first sensor switch and a respective second sensor switch located at each level and forming a pair. The game device further includes a set of first game pieces for a first player or side; each first game piece has an inner bore positionable over any specific post of the plurality of game posts, and a first auxiliary sensor portion configured to engage with any one of the first sensor switches of the specific post while not engaging with a corresponding second sensor switch forming a pair with the any one of the first sensor switches. The game device further includes a set of second game pieces for a second player or side; each second game piece has an inner bore positionable over any specific post of the plurality of game posts, and a second auxiliary sensor portion configured to engage with any one of the second sensor switches of the specific post while not engaging with a corresponding first sensor switch forming a pair with the any one of the second sensor switches. The game device further comprises a first electronic circuit system having a plurality of first sub-circuits. Each first sub-circuit electrically connects a specific set of first sensor switches and light devices arranged at a specific set of horizontally, transversely, vertically or diagonally aligned levels of the plurality of game posts. Each sub-circuit is configured to activate the light devices of the specific set of first sensor switches and light devices to emit a first distinguishing light when the first sensor switches of the specific set of first sensor switches and light devices are simultaneously engaging with first auxiliary sensor portions of respective first game pieces placed at the specific set of horizontally, transversely, vertically or diagonally aligned levels. The game device further includes a second electronic circuit system comprising a plurality of second sub-circuits. Each second sub-circuit electrically connects a specific set of second sensor switches and light devices arranged at a specific set of horizontally, transversely, vertically or diagonally aligned levels of the plurality of game posts. Each sub-circuit is configured to activate the light devices of the specific set of second sensor switches and light devices to emit a second distinguishing light when the second sensor switches of the specific set of second sensor switches and light devices are simultaneously engaging with second auxiliary sensor portions of respective second game pieces placed at the specific set of horizontally, transversely, vertically or diagonally aligned levels.

In a second aspect, the game board can be rotatably supported on a bottom platform.

In a further aspect, the plurality of game posts can include nine game posts arranged in a three-by-three array of game posts. Each game post can include three levels.

In another aspect, the plurality of first sub-circuits can consist of forty-nine different first sub-circuits and the plurality of second sub-circuits can consist of forty-nine different second sub-circuits.

In yet another aspect, each game post can further include a respective light device arranged at each level of each game post.

In another aspect, the first and/or second game pieces can include an outer visible distinguishing feature differentiating the first game pieces from the second game pieces.

In another aspect, the first and second game pieces can include a respective outer visible distinguishing feature differentiating an upright orientation from an inverted orientation of the first and second game pieces.

In yet another aspect, the first and second game pieces can be at least partially translucent.

In another aspect, the first and second game pieces can be cubes having inner bores configured to fit onto each game post of the plurality of game posts.

In another aspect, the first and second game pieces can have translucent sides, a translucent top and an opaque bottom.

In yet another aspect, the first auxiliary sensor portion can include an electrically conductive contact positioned in the inner bore of the first game piece. In some embodiments, the electrically conductive contact can be adjacent the translucent top of the first game piece.

In a further aspect, the second auxiliary sensor portion can include an electrically conductive contact positioned in the inner bore of the second game piece. In some embodiments, the electrically conductive contact can be adjacent the opaque bottom of the second game piece.

In another aspect, the first auxiliary sensor portion can comprise an electrically conductive contact positioned in the inner bore of the first game piece adjacent a top of the first game piece, and the second auxiliary sensor portion can comprise an electrically conductive contact positioned in the inner bore of the second game piece adjacent a bottom of the second game piece.

In another aspect, the game device can further include a sound circuit configured to emit a sound when the first electronic circuit system emits a first distinguishing light or when the second electronic circuit system emits a second distinguishing light.

In yet another aspect, the game posts can be at least partially translucent.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
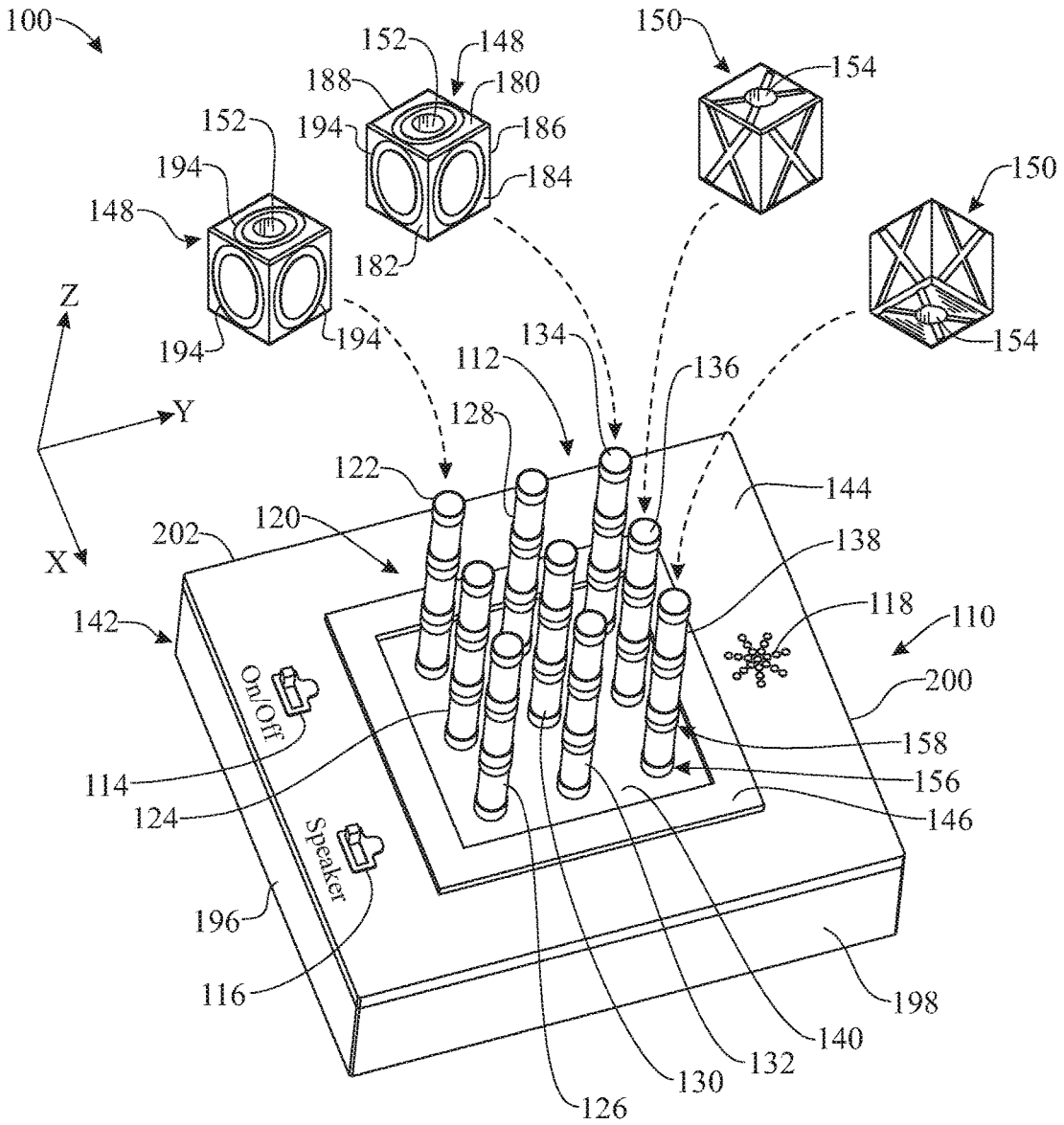
FIG. 1 presents a perspective view of an exemplary embodiment of a three-dimensional tic-tac-toe game device in accordance with the present invention.

Referring to FIGS. 1-4, and initially with regard to FIG. 1, a three-dimensional tic-tac-toe game device 100 is illustrated in accordance with an exemplary embodiment of the present invention. The game device 100 is provided to allow players to play a game of tic-tac-toe in three dimensions and give a visual and/or audio (both, in the present embodiment) indication of a win when one player gets the typical tic-tac-toe three in a row as described in more detail hereinbelow.

The game device 100 generally includes a base 110 having a game board 112 mounted on the base 110. The base 110 includes an on/off power switch 114, an on/off speaker switch 116 and a speaker 118. The power switch 114 is provided to energize the game board 112, i.e. provide the game board 112 with power for circuitry, lights and the speaker 118. In turn, the speaker switch 116 engages and disengages the speaker 118 depending on the whims of the players.

The game board 112 includes a three-by-three array of game posts 120 providing a structure for playing a three-dimensional tic-tac-toe game. The three-by-three array of game posts 120 has nine individual posts including a first post 122, a second post 124, a third post 126, a fourth post 128, a fifth post 130, a sixth post 132, a seventh post 134, an eighth post 136 and a ninth post 138. The array of game posts 120 is mounted on and extends upwardly from a base plate 140 of the game board 112. The base 110 includes a housing 142 and the base plate 140 of the game board 112 is removably mounted on an upper surface 144 of the housing 142. The base plate 140 can optionally be secured to the upper surface 144 of the housing 144 by flange 146. Alternative securing means are contemplated such as screws, an adhesive or the like.

As shown, the individual posts of the array of game posts 120 are equally spaced apart from one another and form a three-dimensional playing area according to standard x-y-z coordinates corresponding respectively to the horizontal or left-to-right direction, the transverse or front-to-back direction and the vertical or up-and-down direction as indicated in FIG. 1. Being three-dimensional, the game board 112 includes, in addition to the standard single plane tic-tac-toe board, two additional planes of play to form three levels in total, a first level or Level 1 adjacent the base plate 140, a second level or Level 2 above that, and a third level or Level 3 above Level 2 and at the top as shown. As described in more detail hereinbelow, each post has two separate illumination devices located within each post and per each of the three levels along the post, i.e., six illumination devices per post (see FIGS. 5 and 6).

The game device 100 additionally includes a plurality of three-dimensional game blocks or pieces, shaped to stack on one another. For instance and without limitation, the blocks can be shaped as cubes. The plurality of cubes is divided into two sets of clearly distinguishable cubes, such as O-cubes 148 and X-cubes 150. In the present description, the terms "O-cube" and "X-cube" are used to refer to cubes marked with an "O" symbol and an "X" symbol, respectively. The O-cubes 148 and X-cubes 150 are positionable over the individual posts in the array of game posts 120 and can be placed at the various levels, i.e. at Levels 1 through 3. As shown in FIG. 1, the O-cubes include an inner bore 152 which fits over the individual posts of the array of game posts 120 and the X-cubes 150 also include respective inner bores 154 fitting over the individual posts. A winner is one who gets three of their game pieces, O-cubes 148 or X-cubes 150, in a row in any combination either transversely, horizontally or diagonally within a single level or plane of the three Levels 1-3 as in normal single-level tic-tac-toe play or, additionally, any of the transverse, horizontal or diagonal directions running vertically within or across the three Levels 1-3.

Figure 6:
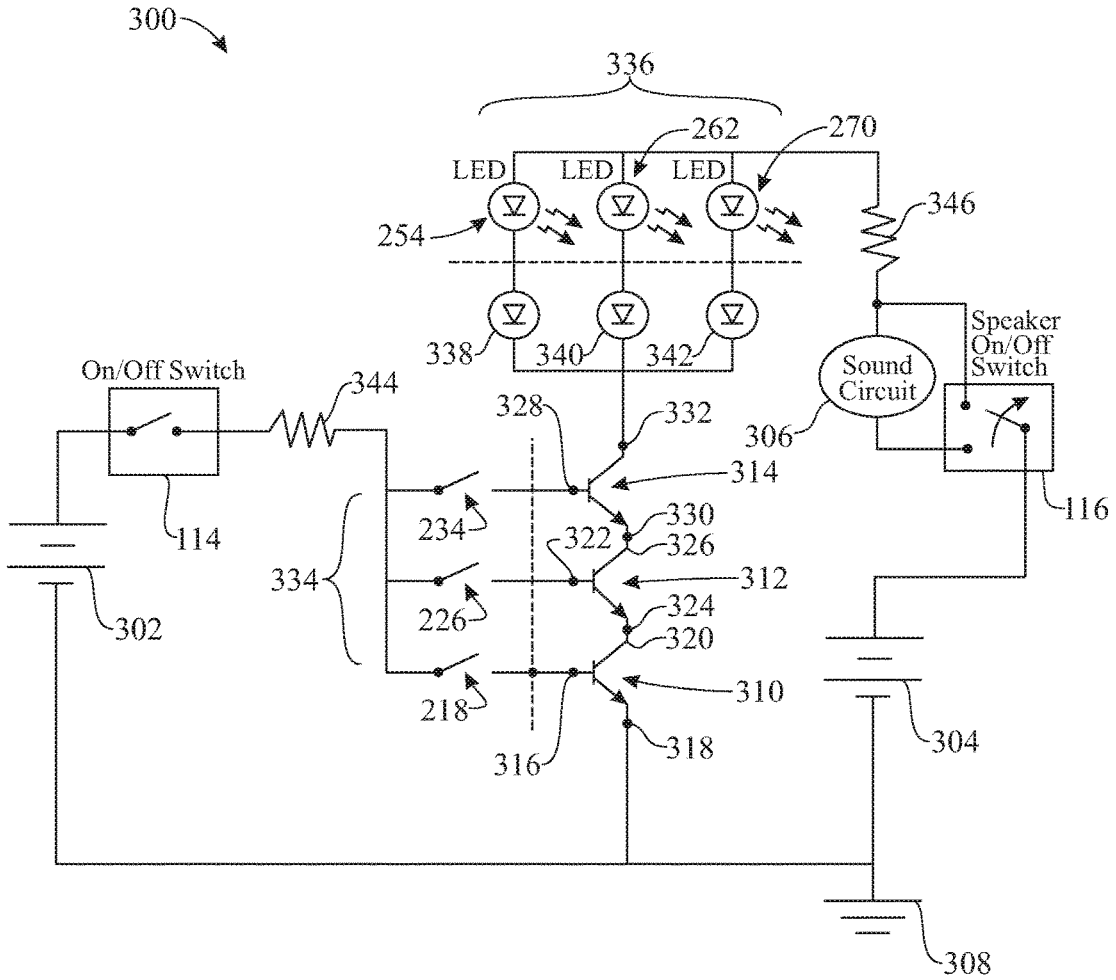
FIG. 6 presents an electrical schematic of one of ninety-eight electrical sub-circuits comprised in an electrical circuit system of the three-dimensional tic-tac-toe game device, and more specifically an electrical sub-circuit used to illuminate three X-cubes in a row formed by a third level of the third post, a second level of the sixth post and a first level of the ninth post.

As noted above, the game device 100 includes circuitry (a representative portion of which is illustrated in FIG. 6) to activate the illumination devices to indicate when a player has accomplished three of his pieces or cubes in a row within the array of posts 120 to get a win in the game. For each of the two teams or players, there are forty-nine (49) different possible rows which can be formed in the three-dimensional, three-by-three-by-three array formed by the array of game posts 120, each individual post provided with three vertical levels (Levels 1-3). In other words, in order to jointly activate the corresponding illumination devices of each possible row, the game device 100 includes ninety-eight (98) three-in-a-row circuits, divided into forty-nine (49) X-cube circuits and forty-nine (49) O-cube circuits. Each X-cube circuit provides for illumination of a specific three-in-a-row arrangement of X-cubes; the three-by-three array of game posts 120 provides for forty-nine (49) different combinations or three-in-a-row arrangements, hence the forty-nine (49) different X-cube circuits. Similarly, each O-cube circuit provides for illumination of a specific three-in-a-row arrangement of O-cubes. The X-cube circuits and O-cube circuits are explained in detail hereinafter.

Forming part of the circuits, the game board 112 includes an array of electrically conductive O-contacts or O-switches 156 and an array of electrically conductive X-contacts or X-switches 158 positioned on the array of posts 120 and across the Levels 1-3. The O-switches 156 are positioned on the bottom of each of the Levels 1-3 on each individual post while the X-switches 158 are positioned at the top of each of the Levels 1-3 on each individual post.

Figure 2:
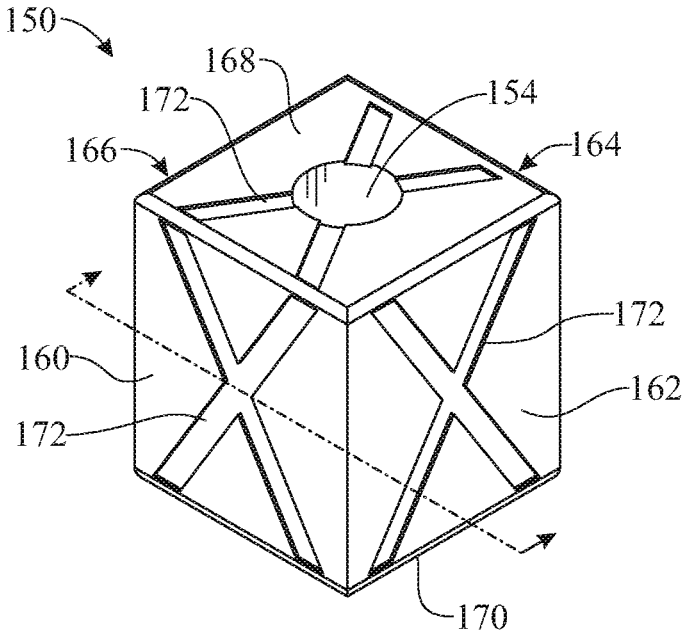
FIG. 2 presents an isometric top view of an X-cube of the three-dimensional tic-tac-toe game device of the present invention.
Figure 3:
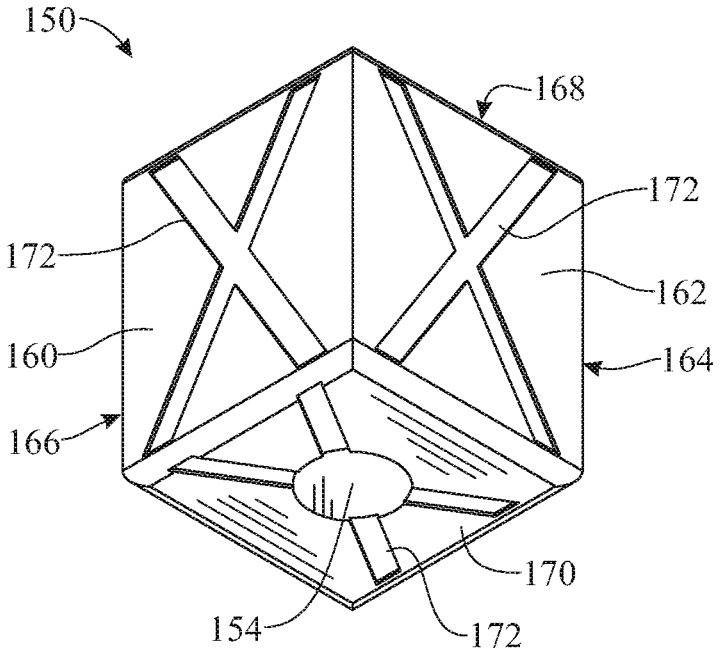
FIG. 3 presents an isometric bottom view of the X-cube of the three-dimensional tic-tac-toe game device of the present invention.

Turning now to FIGS. 2 and 3, there is illustrated a single X-cube 150 having an inner bore 154 as described above. The X-cube 150 is formed from a translucent material such as, for example, translucent plastics or polymers, glass or translucent ceramics, etc., and includes light-passing or translucent side faces 160, 162, 164 and 166 and a translucent top face 168 (FIG. 2). The translucent side faces 160, 162, 164, 166 along with the translucent top face 168 permit light emitted from the posts to pass through the X-cube 150 to indicate a win as described in more detail hereinbelow. Further, as shown in FIG. 3, the X-cube 150 includes a light blocking or opaque bottom face 170 to prevent illumination from a lower cube or post from passing up through and falsely illuminating the X-cube 150. The opaque bottom face 170 additionally provides a reference for the user to distinguish the correct upright orientation of the X-cube 150 in order to properly place the cube on a post and ensure the correct orientation of the X-cube 150 relative to the array of X-switches 158 on the post as described below. The opaque bottom face 170 may be colored or otherwise tinted to further differentiate it from the translucent sides. Alternatively, the opaque bottom face 170 may be formed from a separate piece of opaque material and glued, welded or otherwise secured to the bottom of the opaque X-cube 150. As shown, first indicia or X's 172 are provided on all six faces of the X-cube 150 so a player can tell who's cube it is from any angle. One skilled in the art may understand that the number of X's 172 may vary, and that the cube may include an alternative or additional marking or distinguishing feature (e.g. a color) allowing to distinguish the cube from the opponent cubes.

Figure 4A:
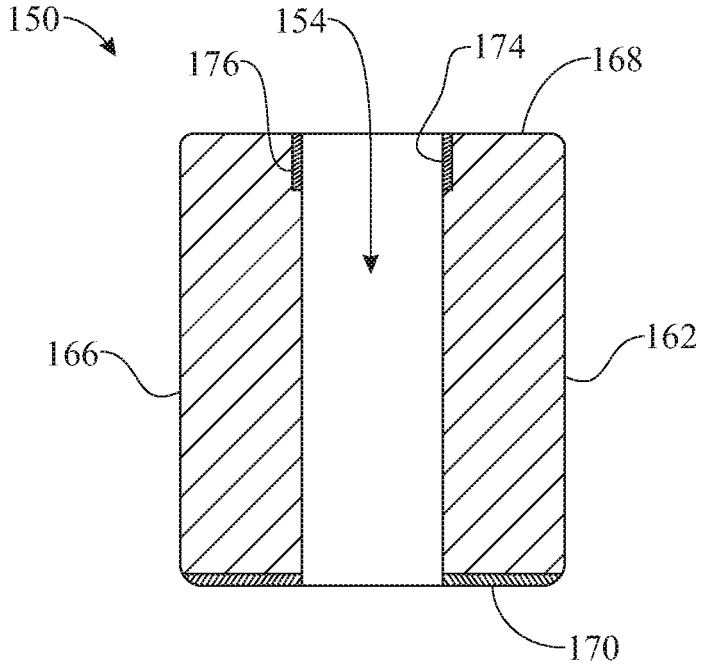
FIG. 4A presents a cross-sectional front elevation view of the X-cube of the three-dimensional tic-tac-toe game device of the present invention revealing a top electrical contact.

Turning now to FIG. 4A, there is illustrated a cross-sectional front elevation view of the X-cube 150. As shown, the X-cube 150 includes the opaque bottom face 170 and translucent top and side faces 168, 162, 164 and 166 respectively. A single electrical contact, hereinafter referred to as electrical X-contact 174, is positioned adjacent the translucent top face 168. The electrical X-contact 174 is cylindrical and sleeve-shaped and extends down adjacent to and into the inner bore 154 of the X-cube 150. The X-contact is friction fit within the inner bore 154 or may be secured within an inner recess 176 in the X-cube 150 surrounding the inner bore 154. The X-contact 174 is provided to engage, with or without physical contact, with a corresponding switch of the array of X-switches 158 that are provided at each level on each individual post and close that X-switch to provide a positive sensing; in the present embodiment, the X-contact 174 is specifically provided to physically contact the corresponding switch of the array of X-switches 158 and form a closed electrical circuit. Alternative embodiments are contemplated in which the X-contacts 174 and X-switches 158 are alternatively constructed to jointly provide a switch; for instance and without limitation, the X-contacts 174 and X-switches may be magnetic sensing switches, proximity sensing switches, or the like.

Figure 4B:
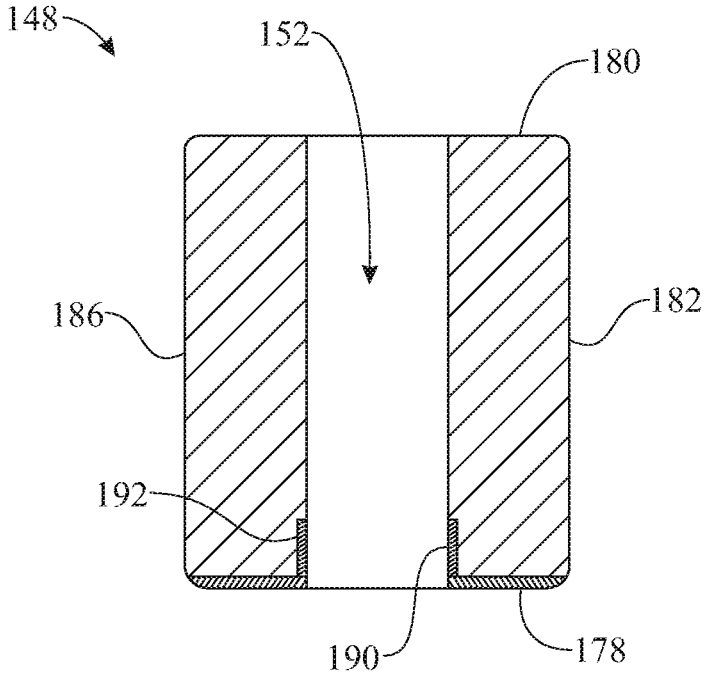
FIG. 4B presents a cross-sectional front elevation view of an O-cube of the three-dimensional tic-tac-toe game device of the present invention revealing a bottom electrical contact.

Similarly to FIG. 4A and with reference to FIG. 4B, there is illustrated a cross-sectional front elevation view of the O-cube 148 which is also formed from a translucent material and has an opaque bottom face 178. It should be noted that while not specifically shown in FIG. 4B, the O-cube also has translucent top face 180 and side faces 182, 184, 186, 188 (FIG. 1). The O-cube 148 also has a single electrical contact, hereinafter referred to as electrical O-contact 190. The O-contact 190 of the depicted embodiment is also cylindrical and is fit within the inner bore 152 in the same manner as the X-contact 174 in the inner bore 154 of the X-cube 150. The O-cube may also have an inner recess 192 to receive the O-contact 190. In contrast to the X-cube 150 however, the O-contact 190 is positioned within the inner bore 152 adjacent the opaque bottom face 178. By placing the O-contact 190 adjacent the opaque bottom face 178 in the O-cube 148, the O-contact 190 is in a position to engage the O-switches in the array of O-switches 156 positioned at the lower end of each of the three Levels 1-3 on the individual posts and complete a circuit in a manner described hereinabove with regard to the X-contact 174 in the X-cube 150. As best shown in FIG. 1, the O-cube 148 of the illustrated embodiment also includes second indicia 194, such as an "O" on the translucent top face 180, translucent side faces 182, 184, 186, 188 and opaque bottom face 178.

Figure 5:
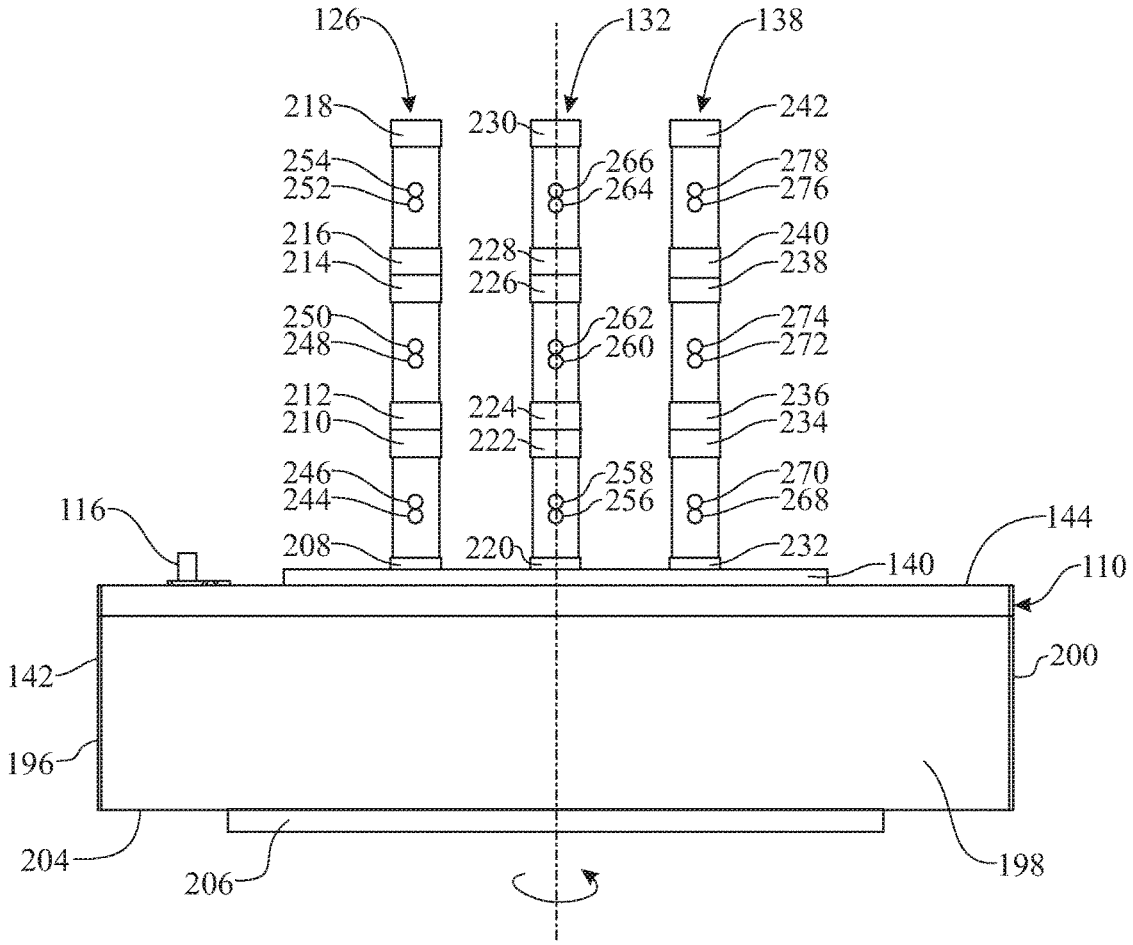
FIG. 5 presents a side elevation view of the three-dimensional tic-tac-toe game device.

With reference to FIGS. 1 and 5, the housing 142 of the base 110 includes the upper surface 144, side surfaces 196, 198, 200 and 202 and a bottom surface 204. The base 110 can further include a bottom platform 206 which is rotatably mounted to and protrudes downwardly from the bottom surface 204 of the housing 142 (FIG. 5). The platform 206 can thus rest on a surface such as a table (not shown), while the bottom surface 204 of the housing 142 remains slightly elevated from the table or other surface. This allows players to easily rotate the housing 142, and virtually the entire game device 100 (except for the platform 206) to better view the placement of the cubes from all sides. Alternative embodiments are contemplated for allowing players to view the cubes from different angles. For instance and without limitation, several casters can protrude downwardly from the housing allowing the game device 100 to roll on a surface; such embodiment allows the game device 100 not only to rotate, but also to slide between players.

With specific reference to FIG. 5, each post within the three-by-three array of game posts 120 is identical except for its position on the base plate 140. With this in mind, the following discussion of the posts will be had with regard to the third post 126, the sixth post 132 and the ninth post 138 as illustrated in FIG. 5. As noted hereinabove, the game board 112 includes the array of O-switches 156 and the array of X-switches 158 positioned on the three-by-three array of game posts 120; more specifically, there is a pair of individual X- and O-switches on each individual post for each of the three playing levels (Levels 1-3). For example, the third post 126 has an O-switch 208 and an X-switch 210 at the bottom level or Level 1, an O-switch 212 and an X-switch 214 at the intermediate level or Level 2, and an O-switch 216 and an X-switch 218 at the top level or Level 3. Similarly, the sixth post 132 has an O-switch 220 and an X-switch 222 at Level 1, an O-switch 224 and an X-switch 226 at Level 2, and an O-switch 228 and an X-switch 230 at Level 3. Likewise, the ninth post 138 has an O-switch 232 and an X-switch 234 at Level 1, an O-switch 236 and an X-switch 238 at Level 2 and an O-switch 240 and an X-switch 242 at Level 3.

As shown and noted hereinabove, the O-switch for each level on a post is at the bottom of the respective level and the X-switch for each level on a post is at the top of each level for that post. The game device 100 includes illumination or lights indicating a win of three of the same O- or X-cubes 148, 150 in a row; more specifically, each post includes two internal lights at each level, one for the X-cube circuits and one for the O-cube circuits, as will be explained hereinafter. These lights illuminate the translucent bodies or sides of the cubes. As noted above, the opaque bottom sides 170 and 178 of the O- and X-cubes 148, 150, respectively, best shown in FIGS. 4A and 4B, prevent illumination of a lower cube from reaching and illuminating a cube above the illuminated cube on an individual post.

The third post 126 includes an internal illumination device or O-light 244 and an internal illumination device or X-light 246 at Level 1 between the O-switch 208 and the X-switch 210, an O-light 248 an X-light 250 between the O-switch 212 and the X-switch 214 at Level 2, and an O-light 252 and an X-light 254 between the O-switch 216 and the X-switch 218 at Level 3. Similarly, the sixth post 132 includes a first pair of an internal illumination device or O-light 256 and an internal illumination device or X-light 258 at Level 1, a second pair of an O-light 260 and an X-light 262 at Level 2, and a third pair of an O-light 264 and an X-light 266 at Level 3, positioned between the related O- and X-switches for each level. The ninth post 138, in turn, includes a first pair of an internal illumination device or O-light 268 and an internal illumination device or X-light 270 at Level 1, a second pair of an O-light 272 and an X-light 274 at Level 2, and a third pair of an O-light 276 and an X-light 278 at Level 3, positioned between the related O- and X-switches for each level.

The lights in this embodiment of the game device 100 are Light Emitting Diodes or LED's, wherein each LED has been schematically depicted as a circle in FIG. 5. One separate LED has been included for each player at each level of the posts. Alternatively, a single LED can be included, such as a bi-color LED. Other forms of illumination controlled by circuitry may also be used for example electroluminescent, fiber optics, etc. The posts can be constructed mainly of a generally transparent or translucent material in order for light to pass through.

As noted above, there are forty-nine (49) circuits for the O-switches and forty-nine (49) circuits for the X-switches corresponding to the number of three-in-a-row combinations for each player's O- or X-cubes. When one specific row combination is achieved by a specific player, the corresponding circuit is activated, as will be explained hereinafter, to illuminate the lights on the row combination and optionally activate the speaker, while the remaining ninety-seven circuits remain inactive. For simplicity, one representative circuit 300 (FIG. 6) of the ninety-eight circuits will be explained in detail hereinafter. The same principles apply to the remaining ninety-seven circuits.

Figure 7:
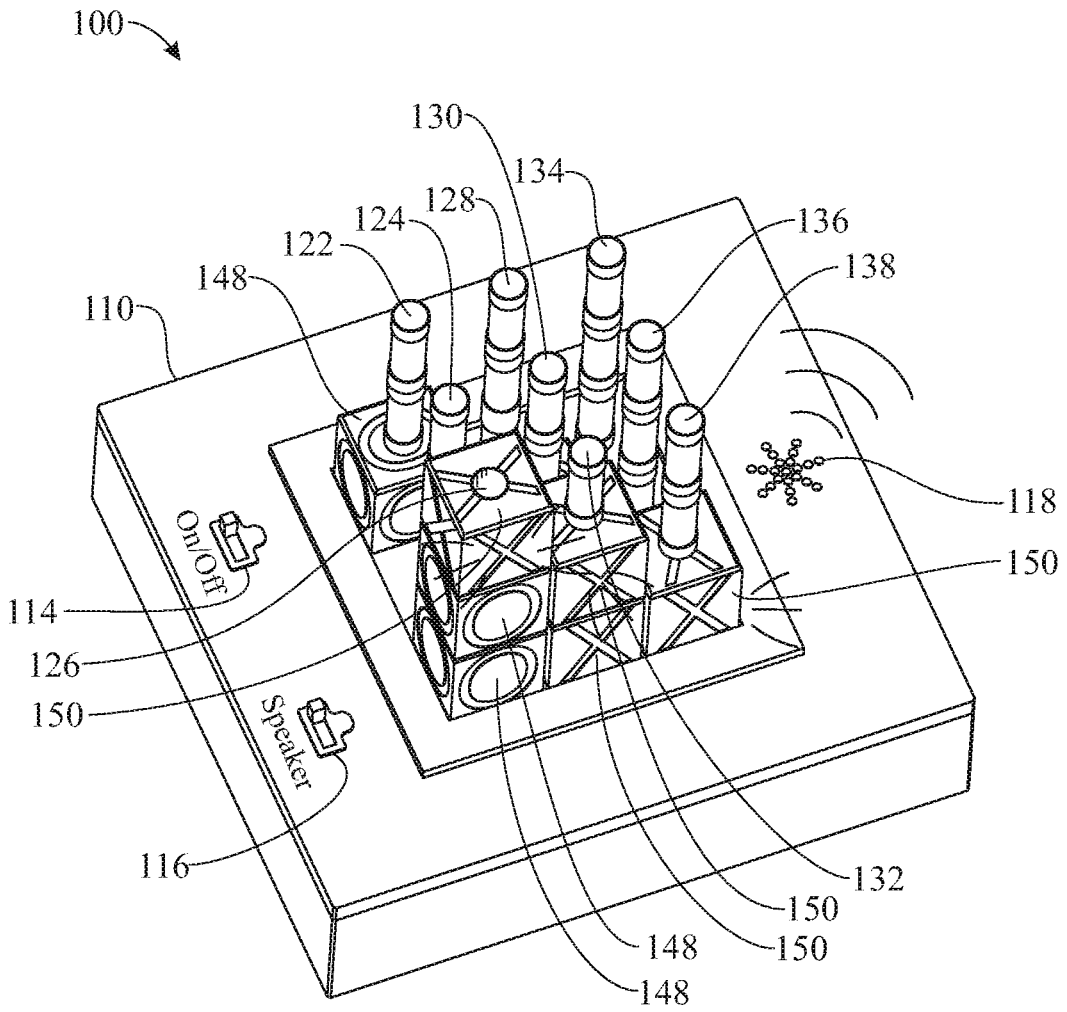
FIG. 7 presents a perspective view of the three-dimensional tic-tac-toe game device with three X-cubes arranged in a row formed by the third level of the third post, the second level of the sixth post and the first level of the ninth post are being illuminated by the electrical sub-circuit of FIG. 6, and sound is being played on the speaker to indicate the X-cube player has won the game.

Referring now to FIG. 6, there is illustrated the electronic circuit 300 for controlling and illuminating the lights of a diagonal row formed by X-cubes 150 placed on Level 3 of the third post 126, Level 2 of the sixth post 132 and Level 1 of the ninth post 138, as shown in FIG. 7. As will be explained, the electronic circuit 300 is formed by components that are common to other circuits, and other components which are exclusive to the present circuit 300.

The circuit 300 includes a first power source 302 and the on/off power switch 114. The first power source 302 provides a continuous voltage between a common ground 308 and the on/off power switch 114. The circuit 300 further includes a second power source 304, the on/off speaker switch 116 and a sound circuit 306 comprising the speaker 118; the sound circuit 306 is commonly known in the art and will not be described in detail so as not to obscure the present description. The second power source 304 provides a continuous voltage between the common ground 308 and the on/off speaker switch 116. The power sources 302, 304 may include a respective battery or batteries, such as a respective 6 V battery. Alternative embodiments are contemplated comprising a single power source for powering the full circuit 300. In some embodiments, the power source can include an adapter for transforming alternate voltage into continuous voltage. The first power source 302, on/off switch 114, second power source 304, common ground 308, on/off speaker switch 116 and sound circuit 306 of the present embodiment are common to all ninety-eight circuits.

At the heart of the circuit 300 is a group of three transistors 310, 312 and 314 arranged in series and which function as electronic switches such that when all three of the transistors 310, 312 and 314 are energized or closed, three corresponding light devices illuminate. The three transistors 310, 312 and 314 can be arranged within a Printed Circuit Board (PCB) (not shown) provided within the housing 142 or base plate 140, for instance and without limitation. As is common with transistors, the transistor 310 includes a base 316, an emitter 318 and a collector 320; likewise, the transistor 312 includes a base 322, an emitter 324 and a collector 326 and the transistor 314 includes a base 328, an emitter 330 and a collector 332. The collector 320 of transistor 310 is connected to the emitter 324 of transistor 312 and the collector 326 of transistor 312 is connected to the emitter 330 of transistor 314.

For the purposes of discussing the circuit 300 generally, the circuit 300 includes a collection or bank of three switches 334 which represent three switches of the type described hereinabove which are provided by the switches on the posts and the sensors within the cubes with regard to the row combination for a specific player. The circuit also includes a bank of three LED's 336 corresponding to the LED's on the posts within the row combination for a specific player. Each individual LED in the bank of three LED's 336 corresponds directly to an individual switch within the bank of three switches 334. For example, one of the switches of the bank of three switches 334 may be the O-switch 208 which is used to energize the O-light 244 in response to an O-cube 148 being positioned at Level 1 on the third post 126 (FIG. 5).

Diodes 338, 340 and 342 can also be arranged on the aforementioned PCB, for instance and without limitation, and are positioned between the transistors and the bank of LED's 336 to prevent the wrong circuits from closing. Specifically, the diodes act a directional gates or doors controlling the direction of flow of the current to the bank of LED's 336. A first resistor 344 is positioned between the on/off switch 114 and the bank of three switches 334. A second resistor 346 is positioned between the bank of three LED's 336 and the sound circuit 306. The first and second resistors 344 and 346 can also be arranged on the aforementioned PCB, for instance and without limitation, and are provided to limit the current through the circuit 300 and to the bank of the transistors 334 and the bank of the LED's 336.

As noted, each of the ninety-eight circuits analogous to circuit 300 (forty-nine for the X's and forty-nine for the O's) corresponds to single combination of three of the same cubes in a specific row on or across the posts either horizontally, transversely, vertically or diagonally. Whenever one switch on a post is closed by a contact of a cube, the associated transistor base is energized. The associated transistor thus switches to a closed condition in which the emitter and collector of that transistor are connected. When three of the same type cubes are placed in a row, and thus the same type of contact closes the three corresponding switches on the posts, the three transistors are simultaneously closed and ground is available at a cathode of a corresponding diode connected to each respective LED which then become conductive and illuminate.

With reference now to FIGS. 1 and 5-7, a specific instance of a player getting three same cubes in a row to illuminate the cubes and get a win in the game will now be described. As best seen in FIG. 1, initially there are no O- or X-cubes 148 and 150 positioned on any of the posts in the 3×3 array of game posts 120. The game is energized by activating the power on/off switch 114 and, if desired, the sound circuit 306 is energized by activating the speaker on/off switch 116.

The players take turns placing their cubes, either O-cubes 148 or X-cubes 150 on various posts in an attempt to get three of the same type cubes in a row (FIG. 7). For example, a first player may place his X-cube 150 on the ninth post 138 at Level 1 and the second player may place his O-cube 148 on post the first post 122 at Level 1. In the next round, the first player may place his next X-cube 150 on the sixth post 132 at Level 1 trying to get three in a row transversely along Level 1. The second player may place his next O-cube 148 on the third post 126 at Level 1 thereby blocking the first player from completing three in a row and setting him or herself up to get three in a row across the front of the game board 112 horizontally.

It should be noted that each time a cube is placed at a specific level and post, the contact of that cube closes the associated switch on the specific level and post because this switch is common to all three-in-a-row combination circuits associated to the specific level and post, the corresponding transistor of each individual circuit corresponding to the switch is closed, while the remaining transistors of the same circuit remain open and no LED's are illuminated by the circuits. For example, when the X-cube 150 is placed on Level 1 of the ninth post 138, as shown in FIG. 7, the contact 174 of the X-cube 150 engages and closes the X-switch 234 at Level 1 of the ninth post 138 energizing only one of the transistors.

The play continues between the players by placing their X- and O-cubes 150 and 148, respectively, on the posts until one player gets three of their cubes in a row. As best shown in FIGS. 5 and 7, the first player has established for instance three X-cubes 150 in a row running both transversely and vertically, i.e., diagonally across the third, sixth and ninth posts 126, 132 and 138. The X-cube 150 on the ninth post 138 closes the X-switch 234 at Level 1, the X-cube 150 on the sixth post 132 closes the X-switch 226 at Level 2 and the X-cube 150 on the third post 126 closes the X-switch 218 at Level 3 to thus give the first player three X-cubes 150 in a row.

Attention is directed now to FIGS. 6 and 7, wherein FIG. 6 shows the specific X-cube circuit 300 for the row combination formed by Levels 3, 2 and 1 of the third, sixth and ninth posts 126, 132 and 138 respectively. Once closed by the contact 174 in each respective X-cube 150, the now closed X-switch 218 energizes and closes the transistor 310, the now closed X-switch 226 energizes and closes the transistor 312 and the now closed switch 234 energizes and closes the transistor 314. With all three transistors 310, 312 and 314 in the series closed, the bank of LED's 336 associated with the specific posts and levels is activated to illuminate. Specifically, the LED or X-light 270 on the ninth post 138 at Level 1 is activated to illuminate through the translucent sides of the X-cube 150 (FIG. 7). Likewise, the LED's or X-lights 262 and 254 on the sixth and third posts 132 and 126 at Levels 2 and 3 illuminate through the translucent sides of the X-cubes 150 at those locations to give a positive, visual indication of a three-cubes-in-a-row win, as shown in FIG. 7. If the sound circuit 306 has been activated, the sound circuit is closed through the second resistor 346 and a chosen or preprogrammed audio indication of a win will also sound.

By way of example, with regard to FIGS. 4B, 5 and 7, of a non-win or situation where all three transistors 310, 312 and 314 are not energized and closed, the two O-cubes 148 placed on the third post 126 do not establish a win or activate the LED's or speaker (FIG. 7). Specifically, the O-cube 148 placed over the third post 126 at Level 1 would close the O-switch 208 by engagement with the contact 190 in the inner bore 152 of the O-cube 148 and energize one of the transistors 310, 312, 314 of all the circuits in which Level 1 of the third post 126 is involved. The second O-cube 148 placed over the third post 126 at Level 2 would close the O-switch 212 and energize a one of the transistors 310, 312, 314 of all the circuits in which Level 2 of the third post 126 is involved. In one of such circuits, namely, the circuit corresponding to the vertical O-cube row combination comprising Levels 1, 2 and 3 of the third post 126, two transistors would be activated. But since an X-cube 150 is placed on the third post 126 at Level 3 (FIG. 7), or even in the absence of any cube on the post 126 at Level 3, the O-switch 216 at the third level 3 on the post 126 remains open, and the third transistor of the circuit corresponding to the vertical O-cube row combination comprising Levels 1, 2 and 3 of the third post 126 remains open. As discussed with regard to the circuit 300 (FIG. 6), all three of the switches of the bank of switches 334 need to be simultaneously closed to energize and close all three of the transistors 310, 312 and 314 to thereby energize and activate the bank of three LED's 336 of the row associated to the circuit. Thus, no LED's (for example, O-lights 244 and 248 on third post 126) illuminate through the translucent sides of the O-cubes 148 and no visual or audio indication of a win is given.

The embodiment shown in the drawings illustrates an example of the invention. Alternative embodiments are contemplated, however. For instance, the posts in the array of game posts 120 may include stoppers to allow the game pieces to be placed on a post at a higher level when no piece is in place at a level below it; for example, the posts may include spring-biased or elastic outwardly protruding stoppers between Level 1 and Level 2 and between Level 2 and Level 3, wherein the stoppers can be moved or deformed inward by a downward pushing force exerted by the user on the cubes to allow the passing thereover of the cubes.

Alternative embodiments are contemplated in which the number of posts and/or levels may be greater than three. The corresponding number of circuits and the number of switches, transistors and LED's comprised in each circuit are incremented accordingly.

Further alternative embodiments are contemplated in which the lights (254, 262, etc.) are comprised within the X-cubes and O-cubes instead of within the posts.

In summary, a three-dimensional tic-tac-toe game is herein disclosed, comprising an array of at least posts, each post including at least three vertical levels, each level including two pairs of a light and a switch, one pair for each player. The game comprises ninety-eight circuits, wherein each circuit is related to a specific row combination for a specific player. Each circuit includes three of said pairs of a light and a switch, the three pairs corresponding to a specific three-in-a-row combination for a specific player. Simultaneous closing of the three switches closes a circuit for energizing the corresponding three lights and illuminating the corresponding levels of the posts.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An illuminated, three-dimensional tic-tac-toe game device comprising:

a game board having a plurality of game posts extending vertically upward from the game board, each game post of said plurality of game posts having at least three levels arranged in a vertically stacked relationship, each level comprising a respective first sensor switch and a respective second sensor switch located at said each level and forming a pair;

a set of first game pieces, each first game piece having an inner bore positionable over any specific post of said plurality of game posts, each first game piece further comprising a first auxiliary sensor portion configured to engage with any one of said first sensor switches of said specific post while not engaging with a corresponding second sensor switch forming a pair with said any one of said first sensor switches;

a set of second game pieces, each second game piece having an inner bore positionable over any specific post of said plurality of game posts, each second game piece further comprising a second auxiliary sensor portion configured to engage with any one of said second sensor switches of said specific post while not engaging with a corresponding first sensor switch forming a pair with said any one of said second sensor switches; and a first electronic circuit system, comprising a plurality of first sub-circuits, each first sub-circuit electrically connecting a specific set of first sensor switches and light devices arranged at a specific set of horizontally, transversely, vertically or diagonally aligned levels of the plurality of game posts, said each sub-circuit being configured to activate said light devices of said specific set of first sensor switches and light devices to emit a first distinguishing light when said first sensor switches of said specific set of first sensor switches and light devices are simultaneously engaging with first auxiliary sensor portions of respective first game pieces placed at said specific set of horizontally, transversely, vertically or diagonally aligned levels; and a second electronic circuit system, comprising a plurality of second sub-circuits, each second sub-circuit electrically connecting a specific set of second sensor switches and light devices arranged at a specific set of horizontally, transversely, vertically or diagonally aligned levels of the plurality of game posts, said each sub-circuit being configured to activate said light devices of said specific set of second sensor switches and light devices to emit a second distinguishing light when said second sensor switches of said specific set of second sensor switches and light devices are simultaneously engaging with second auxiliary sensor portions of respective second game pieces placed at said specific set of horizontally, transversely, vertically or diagonally aligned levels.

2. The three-dimensional tic-tac-toe game device of claim 1, wherein the game board is rotatably supported on a bottom platform.

3. The three-dimensional tic-tac-toe game device of claim 1, wherein the plurality of game posts comprises nine game posts arranged in a three-by-three array of game posts, and further wherein said at least three levels of each game post consists of three levels.

4. The three-dimensional tic-tac-toe game device of claim 3, wherein the plurality of first sub-circuits consists of forty-nine different first sub-circuits and the plurality of second sub-circuits consists of forty-nine different second sub-circuits.

5. The three-dimensional tic-tac-toe game device of claim 1, wherein each game post of said plurality of game posts further includes a respective light device arranged at each level of said each game post.

6. The three-dimensional tic-tac-toe game device of claim 1, wherein the first and/or second game pieces comprise an outer visible distinguishing feature differentiating the first game pieces from the second game pieces.

7. The three-dimensional tic-tac-toe game device of claim 1, wherein the first and second game pieces comprise a respective outer visible distinguishing feature differentiating an upright orientation from an inverted orientation of the first and second game pieces.

8. The three-dimensional tic-tac-toe game device of claim 1, wherein the first and second game pieces are at least partially translucent.

9. The three-dimensional tic-tac-toe game device of claim 1, wherein the first and second game pieces are cubes having inner bores configured to fit onto each game post of the plurality of game posts.

10. The three-dimensional tic-tac-toe game device of claim 9, wherein the first and second game pieces have translucent sides, a translucent top and an opaque bottom.

11. The three-dimensional tic-tac-toe game device of claim 10, wherein the first auxiliary sensor portion comprises an electrically conductive contact positioned in the inner bore of the first game piece.

12. The three-dimensional tic-tac-toe game device of claim 11, wherein the electrically conductive contact is adjacent the translucent top of the first game piece.

13. The three-dimensional tic-tac-toe game device of claim 10, wherein the second auxiliary sensor portion comprises an electrically conductive contact positioned in the inner bore of the second game piece.

14. The three-dimensional tic-tac-toe game device of claim 13, wherein the electrically conductive contact is adjacent the opaque bottom of the second game piece.

15. The three-dimensional tic-tac-toe game device of claim 1, wherein the first auxiliary sensor portion comprises an electrically conductive contact positioned in the inner bore of the first game piece adjacent a top of the first game piece, and further wherein the second auxiliary sensor portion comprises an electrically conductive contact positioned in the inner bore of the second game piece adjacent a bottom of the second game piece.

16. The three-dimensional tic-tac-toe game device of claim 1, further comprising a sound circuit configured to emit a sound when the first electronic circuit system emits a first distinguishing light or when the second electronic circuit system emits a second distinguishing light.

17. The three-dimensional tic-tac-toe game device of claim 1, wherein the game posts are at least partially translucent.

18. An illuminated, three-dimensional tic-tac-toe game device comprising:

a game board having a plurality of game posts extending vertically upward from the game board, each game post of said plurality of game posts having at least three levels arranged in a vertically stacked relationship, each level comprising a respective first sensor switch and a respective second sensor switch located at said each level and forming a pair;

a set of at least partially translucent first game pieces, each first game piece having an inner bore positionable over any specific post of said plurality of game posts, each first game piece further comprising a first auxiliary sensor portion configured to engage with any one of said first sensor switches of said specific post while not engaging with a corresponding second sensor switch forming a pair with said any one of said first sensor switches;

a set of at least partially translucent second game pieces, each second game piece having an inner bore positionable over any specific post of said plurality of game posts, each second game piece further comprising a second auxiliary sensor portion configured to engage with any one of said second sensor switches of said specific post while not engaging with a corresponding first sensor switch forming a pair with said any one of said second sensor switches; and a first electronic circuit system, comprising a plurality of first sub-circuits, each first sub-circuit electrically connecting a specific set of first sensor switches and light devices arranged at a specific set of horizontally, transversely, vertically or diagonally aligned levels of the plurality of game posts, said each sub-circuit being configured to activate said light devices of said specific set of first sensor switches and light devices to emit a first distinguishing light when said first sensor switches of said specific set of first sensor switches and light devices are simultaneously engaging with first auxiliary sensor portions of respective first game pieces placed at said specific set of horizontally, transversely, vertically or diagonally aligned levels, said first distinguishing light being emitted through said respective first game pieces; and a second electronic circuit system, comprising a plurality of second sub-circuits, each second sub-circuit electrically connecting a specific set of second sensor switches and light devices arranged at a specific set of horizontally, transversely, vertically or diagonally aligned levels of the plurality of game posts, said each sub-circuit being configured to activate said light devices of said specific set of second sensor switches and light devices to emit a second distinguishing light when said second sensor switches of said specific set of second sensor switches and light devices are simultaneously engaging with second auxiliary sensor portions of respective second game pieces placed at said specific set of horizontally, transversely, vertically or diagonally aligned levels, said second distinguishing light being emitted through said respective second game pieces.

19. The three-dimensional tic-tac-toe game device of claim 18, wherein each game post of said plurality of game posts further includes a respective light device arranged at each level of said each game post.

20. An illuminated, three-dimensional tic-tac-toe game device comprising:

a game board having a plurality of game posts extending vertically upward from the game board, each game post of said plurality of game posts having at least three levels arranged in a vertically stacked relationship, each level comprising a respective first sensor switch and second sensor switch located at said each level and forming a pair and a respective first light device and second light device;

a set of at least partially translucent first game pieces, each first game piece having an inner bore positionable over any specific post of said plurality of game posts, each first game piece further comprising a first auxiliary sensor portion configured to engage with any one of said first sensor switches of said specific post while not engaging with a corresponding second sensor switch forming a pair with said any one of said first sensor switches;

a set of at least partially translucent second game pieces, each second game piece having an inner bore positionable over any specific post of said plurality of game posts, each second game piece further comprising a second auxiliary sensor portion configured to engage with any one of said second sensor switches of said specific post while not engaging with a corresponding first sensor switch forming a pair with said any one of said second sensor switches; and a first electronic circuit system, comprising a plurality of first sub-circuits, each first sub-circuit electrically connecting a specific set of first sensor switches and first light devices arranged at a specific set of horizontally, transversely, vertically or diagonally aligned levels of the plurality of game posts, said each sub-circuit being configured to activate said first light devices of said specific set of first sensor switches and first light devices to emit a first distinguishing light when said first sensor switches of said specific set of first sensor switches and first light devices are simultaneously engaging with first auxiliary sensor portions of respective first game pieces placed at said specific set of horizontally, transversely, vertically or diagonally aligned levels, said first distinguishing light being emitted through said respective first game pieces; and a second electronic circuit system, comprising a plurality of second sub-circuits, each second sub-circuit electrically connecting a specific set of second sensor switches and second light devices arranged at a specific set of horizontally, transversely, vertically or diagonally aligned levels of the plurality of game posts, said each sub-circuit being configured to activate said second light devices of said specific set of second sensor switches and second light devices to emit a second distinguishing light when said second sensor switches of said specific set of second sensor switches and second light devices are simultaneously engaging with second auxiliary sensor portions of respective second game pieces placed at said specific set of horizontally, transversely, vertically or diagonally aligned levels, said second distinguishing light being emitted through said respective second game pieces.

* * * * *